US008827881B2

(12) United States Patent
Marino

(10) Patent No.: US 8,827,881 B2
(45) Date of Patent: Sep. 9, 2014

(54) EXERCISE DEVICE, METHOD OF USE, AND METHOD OF TREATING AN INDIVIDUAL

(76) Inventor: Mark Marino, Stony Brook, NY (US)

( * ) Notice: Subject to any disclaimer, the term of this patent is extended or adjusted under 35 U.S.C. 154(b) by 255 days.

(21) Appl. No.: 13/092,222

(22) Filed: Apr. 22, 2011

(65) Prior Publication Data

US 2011/0287913 A1 Nov. 24, 2011

Related U.S. Application Data

(60) Provisional application No. 61/327,329, filed on Apr. 23, 2010.

(51) Int. Cl.
*A63B 21/012* (2006.01)
*A63B 21/015* (2006.01)
*A63B 26/00* (2006.01)

(52) U.S. Cl.
CPC ..... *A63B 26/00* (2013.01); *A63B 2208/0252* (2013.01); *A63B 2208/0257* (2013.01)
USPC ..... 482/142; 482/145; 482/146

(58) Field of Classification Search
USPC ..... 482/130, 142, 143, 79, 124
See application file for complete search history.

(56) References Cited

U.S. PATENT DOCUMENTS 3,262,701 A * 7/1966 Howland ..... 482/146
4,613,131 A * 9/1986 Anderson ..... 482/146
4,848,742 A 7/1989 Lindley et al.
5,007,414 A 4/1991 Sexton
5,180,386 A * 1/1993 Kennedy, Jr. ..... 606/240
5,279,310 A 1/1994 Hsien
5,897,474 A * 4/1999 Romero ..... 482/146
7,060,085 B2 6/2006 Graham et al.
7,288,077 B2 10/2007 Notestine
7,316,707 B2 1/2008 Kalina et al.
7,357,766 B2 * 4/2008 Langer et al. ..... 482/146
7,479,096 B2 * 1/2009 Saikawa ..... 482/100
2008/0039304 A1 * 2/2008 Mattox ..... 482/130

OTHER PUBLICATIONS

CorDisc Document filed in the U.S. Patent & Trademark Office on Dec. 19, 2003 during prosecution for patent No. D507,311.*
VersaDisc and CorDisc Web Screen Shots dated Mar. 2, 2013, Dec. 25, 2010 and Dec. 27, 2009.*

* cited by examiner

*Primary Examiner* — Loan H Thanh
*Assistant Examiner* — Rae Fischer
(74) *Attorney, Agent, or Firm* — Carter, DeLuca, Farrell & Schmidt, LLP

(57) ABSTRACT

An exercise device is disclosed. The exercise device includes a first portion and a second portion. The first portion includes a first substantially planar surface and is configured to support a portion of a patient. The second portion includes a second substantially planar surface and is configured to support a portion of a patient. The second substantially planar surface is oppositely disposed of the first substantially planar surface. The first substantially planar surface includes a diameter, and the second substantially planar surface includes a diameter. The diameter of the first substantially planar surface is smaller than the diameter of the second substantially planar surface.

6 Claims, 4 Drawing Sheets

EXERCISE DEVICE, METHOD OF USE, AND METHOD OF TREATING AN INDIVIDUAL

CROSS-REFERENCE TO RELATED APPLICATION

The present application claims the benefits of and priority to U.S. Provisional Application Ser. No. 61/327,329 filed on Apr. 23, 2010. The entire contents of which are incorporated herein by reference.

BACKGROUND

The present disclosure relates to an exercise device, method of use, and method of treating an individual. In particular, the exercise pad or device includes a self help body treatment device and/or an exercise device.

This device is configured to allow an individual to be positioned thereon and to pivot thereon, for example, which allows their muscles, joints and/or soft tissue structures of many regions of the body to relax, stretch and improve mobility. The device also promotes and enhances strength and core stability. The shape/size of various dimensions of the device may vary (e.g., small, medium and large sizes) to accommodate various body types and sizes.

The device is generally disc-shaped including a first portion and a second portion. The device is intended to be used by an individual either with the first or second portion facing upward, and with at least a portion of the other surface resting on a substantially flat surface.

SUMMARY

The present disclosure relates to an exercise device. The exercise device includes a first portion and a second portion. The first portion includes a first substantially planar surface and is configured to support a portion of a patient. The second portion includes a second substantially planar surface and is configured to support a portion of a patient. The second substantially planar surface is oppositely disposed of the first substantially planar surface. The first substantially planar surface includes a diameter, and the second substantially planar surface includes a diameter. The diameter of the first substantially planar surface is smaller than the diameter of the second substantially planar surface.

The present disclosure also relates to a method of treating a patient. The method comprises providing an exercise device. The exercise device includes a first portion and a second portion. The first portion includes a first substantially planar surface and is configured to support a portion of a patient. The second portion includes a second substantially planar surface and is configured to support a portion of a patient. The second substantially planar surface is oppositely disposed of the first substantially planar surface. The first substantially planar surface includes a diameter, and the second substantially planar surface includes a diameter. The diameter of the first substantially planar surface is smaller than the diameter of the second substantially planar surface. The method also comprises providing instructions to the patient regarding use of the exercise device.

The present disclosure also relates to a method of using an exercise device. The exercise device includes a first portion and a second portion. The first portion includes a first substantially planar surface and is configured to support a portion of a patient. The second portion includes a second substantially planar surface and is configured to support a portion of a patient. The second substantially planar surface is oppositely disposed of the first substantially planar surface. The first substantially planar surface includes a diameter, and the second substantially planar surface includes a diameter. The diameter of the first substantially planar surface is smaller than the diameter of the second substantially planar surface. The method also comprises placing a portion of a body in contact with one of the first portion and the second portion.

BRIEF DESCRIPTION OF DRAWINGS

Embodiments of the presently disclosed device are disclosed herein with reference to the drawings, wherein.

DETAILED DESCRIPTION

Figure 1:
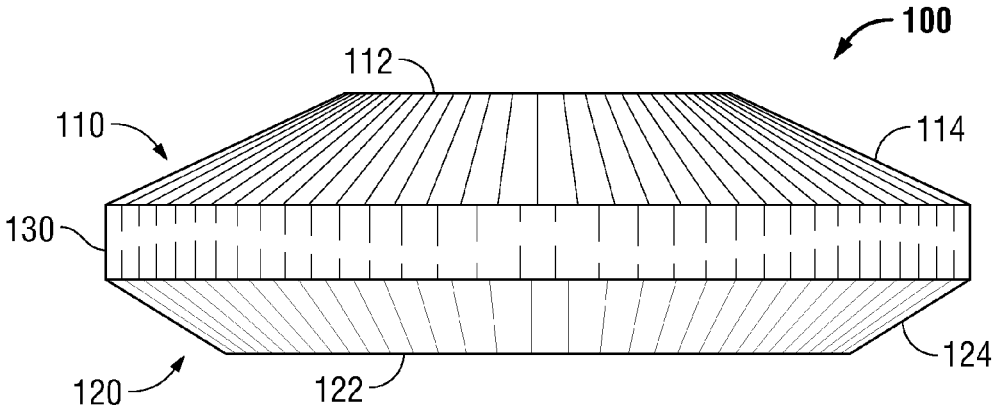
FIG. 1 is a side view of the device with a first portion facing upward.
Figure 2:
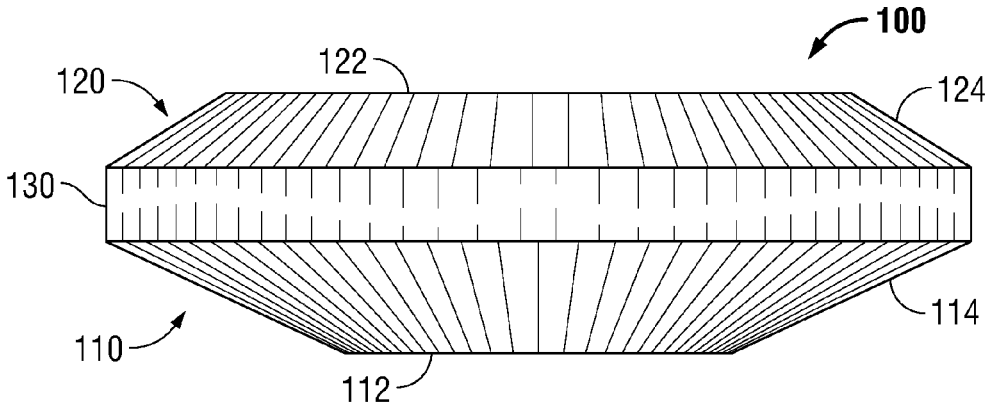
FIG. 2 is a side view of the device with a second portion facing upward.

Embodiments of the presently disclosed device and methods are now described in detail with reference to the drawings wherein like reference numerals identify similar or identical elements. It shall be noted that all dimensions shown in the accompanying figures and described herein are included as examples, and the scope of the present disclosure is not intended to be limited thereby. As used herein, the term "exercise," as in "exercise device" or "exercise pad", for example, includes "therapy," "therapeutic," etc.

Various embodiments of the device 100 of the present disclosure are described herein. It is envisioned that the device 100 may include a diameter of between about 4" and about 10" (e.g., between about 6" and about 7"), for example. The device 100 may include a height of between about 1" and about 3.5" (e.g., between about 1.75" and about 2.25"), for example. The first portion 110 of the device may include a flat (e.g., substantially planar) surface 112 having a diameter of between about 1.5" and about 3.5 (e.g., between about 2.25" and about 2.75"), for example. The second portion 120 of the device may include a flat (e.g., substantially planar) surface 122 having a diameter of between about 3.5" and about 6.5" (e.g., between about 4.25" and about 5.25"), for example.

Figure 3:
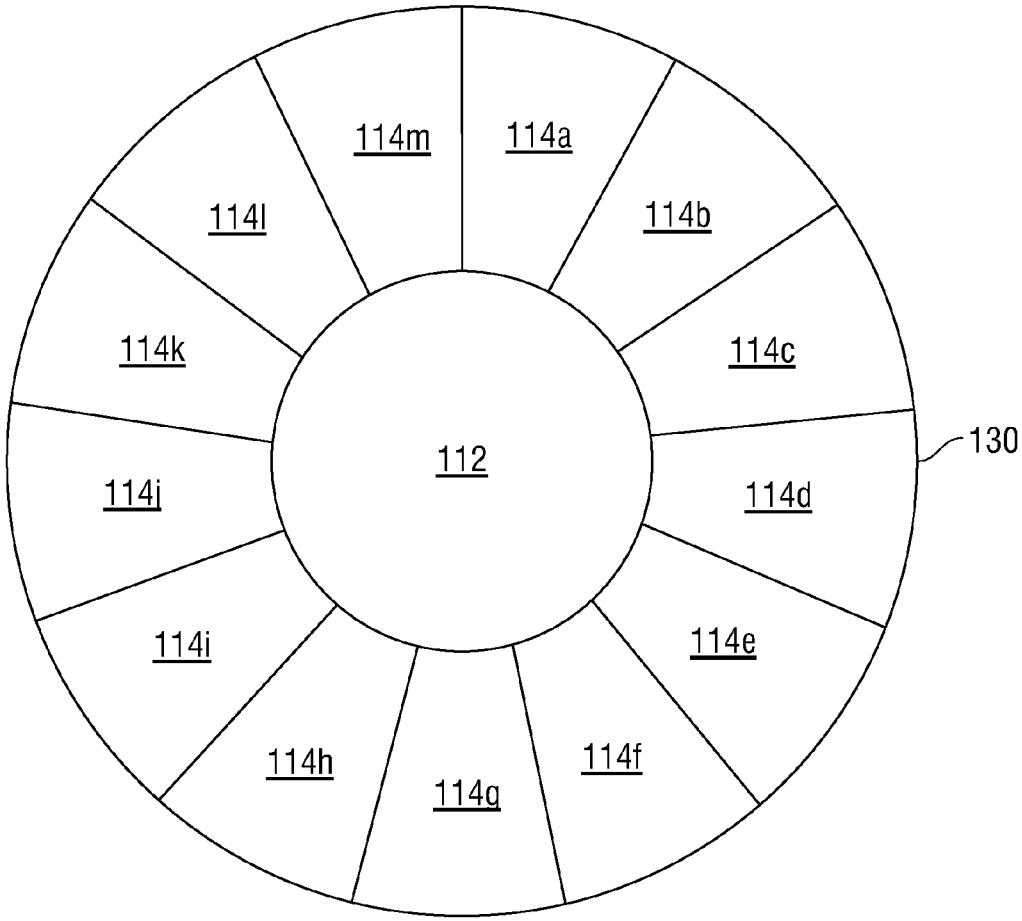
FIG. 3 is a top view of the device with the first portion facing upward.
Figure 4:
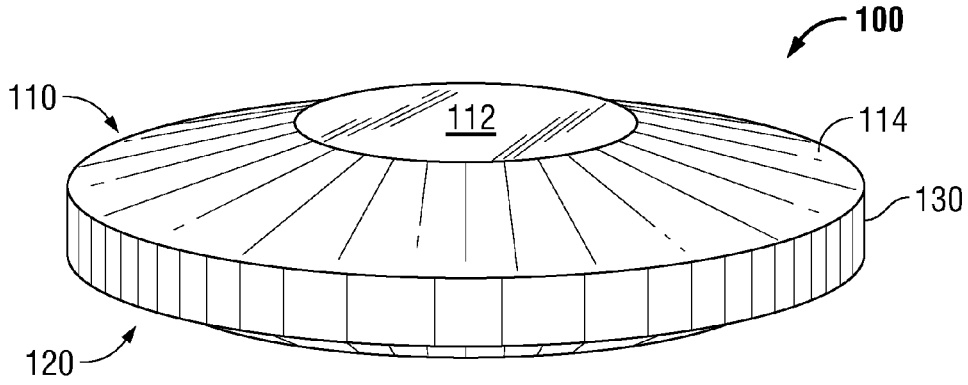
FIG. 4 is a perspective view of the device with the first portion facing upward.
Figure 5:
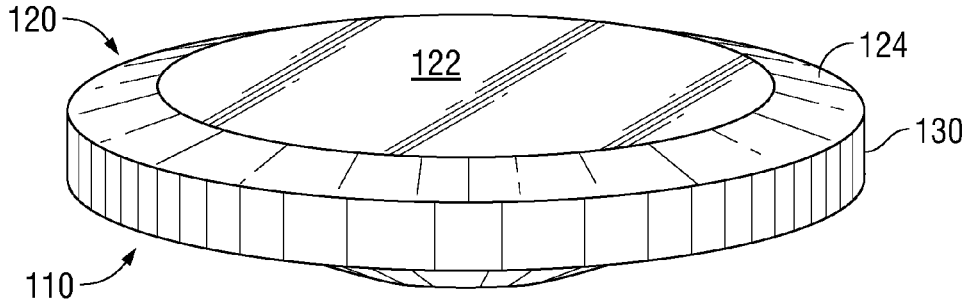
FIG. 5 is a perspective view of the device with the second portion facing upward.
Figure 6:
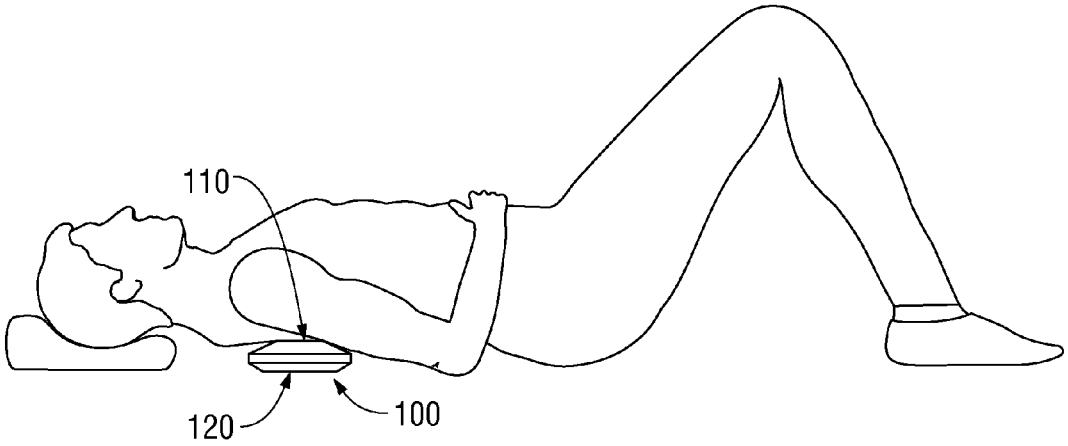
FIG. 6 illustrates the device under an individual with the first portion facing upward.
Figure 7:
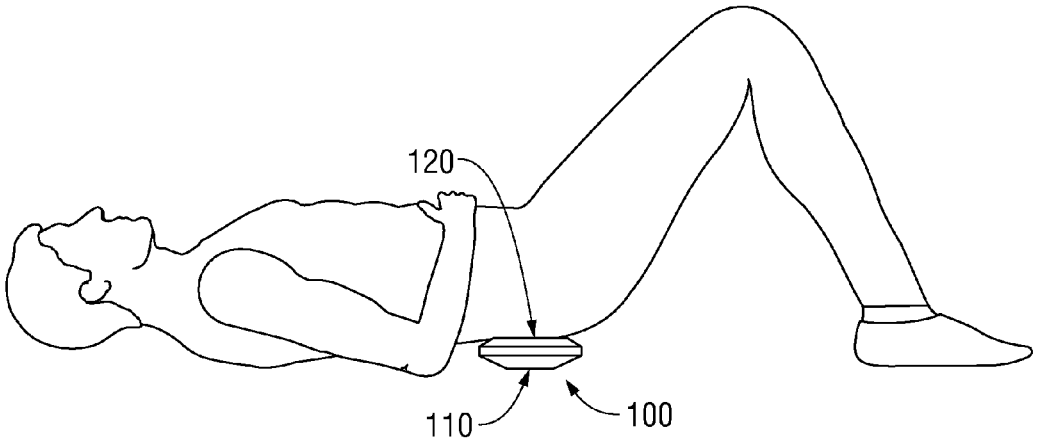
FIG. 7 illustrates the device under an individual with the second portion facing upward.

The first portion 110 and second portion 120 are shown as being separated by a substantially vertical sidewall 130. It is envisioned that the height of vertical sidewall 130 is between about 0.25" and about 1.0." It is further envisioned that the height of vertical sidewall 130 is between about 0.5" and about 0.75". A first angled surface 114 is defined between the vertical sidewall 130 and an outer edge of first flat surface 112. It is envisioned that first angle surface 114 is substantially flat along its entire length. Additionally, with reference to FIG. 3, it is envisioned that angled surface 114 includes a plurality of sections 114*a*, 114*b*, etc. (a total of 13 sections (i.e., 114*a*-114*m*) are shown), which may facilitate incremental rotational movement, or instance. As can be appreciated, more or fewer sections are contemplated by the present disclosure. It is envisioned that the first angled surface 114 defines a first angle $\alpha_1$ of between about 20° and about 25°, for example. This angle/surface 114 creates a pyramidal shape, which allows for rotation and/or pivoting around/about the smaller-diameter flat surface 122, e.g. in a 360° motion.

A second angled surface 124 is defined between the vertical sidewall 130 and an outer edge of second flat surface 114. It is envisioned that the second angled surface 124 is substantially rounded or substantially flat. It is envisioned that the second angled surface 124 defines a second angle $\alpha_2$ of between about 25° and about 45°, for example, and may be equal to about 30°.

The device 100 may include a contoured shape; may be made of injection molded high density foam, rubber, or another suitable material; and/or may be disc-shaped, e.g., to allow for multiple functions.

In use, with the first portion 110 (e.g., flat surface 112) of the device 100 facing upwards, a user will be able to actively "tilt" and/or "rotate" the region of the body, e.g., in a clock-type motion or any functional body movement that promotes increased mobility at the region around the device 100. This will allow the joints of the region (e.g., the sacro-iliac SI of the pelvic and lumbar, thoracic, knee, hip, shoulder, etc.) to be exercised, which will increase range of motion ("ROM") and/or flexibility. Use of the device 100 may also promote decreased pain through the use of isolated movement, allow for activation of the core musculature of the spine, and/or promote proprioceptive training for the joints of the body. Additionally, it is envisioned that the device 100 allows the individual to loosen soft tissue structures (e.g., fascia, muscles, tendons and joints) and/or promotes improved flexibility, range of motion, strength and core stability.

In use, with the flat surface 112 of first portion 110 of the device 100 facing upwards, a user will be able to pivot their body (or portions of their body) about the device 100, which may remain substantially stationary during use in this embodiment.

It is envisioned that the device 100 can used both passively and actively with the device 100 in either position, i.e., with either first portion 110 or second portion 120 facing up. It is envisioned that the device 100 can be used as an exercise device to help any individual who desires or needs to increase the mobility of their soft tissues, muscles, tendons, joints and/or other structures. Use of the device 100 by any individual may also help improve flexibility, strength and/or core stability. It is also envisioned that the device 100 may be used by the general public, who are not necessarily in need of rehabilitation.

The present disclosure also includes method of using the device 100 and method of treating individuals (e.g., patients). Individuals can use this device 100 to release or loosen their muscles, tissues and/or joints while promoting their flexibility, range of motion and core stability. This can be accomplished, for example, by doing certain exercises while lying on top of the device 100 with either the first portion 110 or second portion 120 facing upwards. Additionally, the individual can passively lie on the device 100 or in the same position and do a pelvic clock motion which is aided by the device's shape. The device 100 allows the individual to move 360° around the pivot (e.g., flat surface 112 or 122) of the device 100. Additionally, by positioning the device 100 under the thoracic spine or mid back at various levels and lying over it, the individual can loosen the structures in this region of the body. This can be enhanced by initiating active exercises like the pelvic clock or upper extremity raises.

The device 100 may also be used by an individual while performing lower extremity exercises. For example, the individual may use the device 100 to loosen the muscle in the lower quadriceps and enhancing the release by actively flexing and extending the lower extremity over the device. Putting the device 100 under the lateral thigh or Iliotibial band, the tissues can passively loosen, or active exercise can enhance the release of the individual's muscles and/or tissues.

The device 100 may also be used by an individual while performing core stabilization exercises. For example, the device 100 may be used to improve overall mobility, flexibility and/or strength of and individual. It is envisioned that individuals would experience decreased pain in regions where the device 100 is used. The device 100 may also promote enhanced proprioceptive awareness or the awareness of the individual's body movements and improved core stability as well.

The present disclosure also includes methods of treating an individual. A disclosed method includes providing the device 100, providing an individual with access to the device 100, providing an individual with instructions for using the device 100, and/or providing an individual with instructions to use the device 100. The present disclosure also includes an instruction manual and an instructional video for using the device 100, including providing description and/or figures, such as those included herein and/or similar description and/or figures.

It is to be understood that the foregoing description is merely a disclosure of particular embodiments and is in no way intended to limit the scope of the disclosure. For example, it is envisioned that all edges, e.g., between adjacent surfaces, are either rounded or include a point. Additionally, while the device 100 is shown in use in connection to particular portions of the body, the device 100 may be used in connection with any body part. Other possible modifications will be apparent to those skilled in the art and are intended to be within the scope of the present disclosure. Those skilled in the art will envision other modifications within the scope and spirit of the claims appended hereto.

The invention claimed is:

1. A method of using an exercise device, comprising:

providing an exercise device, including:

a first portion including a first substantially planar surface and being configured to support a portion of a patient; and a second portion including a second substantially planar surface configured to support a portion of a patient, the second substantially planar surface being oppositely disposed of the first substantially planar surface;

wherein an axis disposed perpendicularly with respect to the first substantially planar surface and with respect to the second substantially planar surface extends through a mid point of each of the first substantially planar surface and the second substantially planar surface;

wherein the first substantially planar surface includes a diameter, wherein the second substantially planar surface includes a diameter, and wherein the diameter of the first substantially planar surface is smaller than the diameter of the second substantially planar surface wherein the exercise device includes a coefficient of friction that is sufficient to prevent movement of the exercise device when the second portion of the exercise device is in contact with the support surface and while a portion of the user's body is pivoted about the at least one point on the first portion of the exercise device; and wherein the coefficient of friction of the exercise device enables the exercise device to pivot with respect to the support surface when the first portion of the exercise device is in contact with the support surface and while a portion of the user's body is in contact with the second portion of the exercise device;

placing a portion of a user's body in contact with the first portion of the exercise device, placing the second portion of the exercise device in contact with a support surface, and pivoting the portion of the user's body that is in contact with the first portion of the exercise device about at least one point of the first portion of the exercise device while the exercise device remains stationary; and placing a portion of a user's body in contact with the second portion of the exercise device, placing the first portion of the exercise device in contact with a support surface, and causing the exercise device to pivot with respect to the support surface.

2. The method of claim 1, further comprising pivoting the portion of the user's body that is in contact with the second portion of the exercise device 360° around at least one point on the first portion of the exercise device.

3. The method of claim 1, wherein pivoting the portion of the user's body that is in contact with the first portion of the exercise device includes pivoting at least one portion or region of the user's thoracic spine and mid back around at least one point on the first portion of the exercise device.

4. The method of claim 1, further comprising providing instructions to pivot the portion of the patient's body that is in contact with the second portion of the exercise device 360° around at least one point on the first portion of the exercise device.

5. The method of claim 1, further comprising providing instructions to position at least one portion or region of the patient's thoracic spine, mid back, lateral thigh and Iliotibial band in contact with the exercise device.

6. The method of claim 1, further comprising positioning at least one portion or region of the user's thoracic spine, mid back, lateral thigh and Iliotibial band in contact with the exercise device.

* * * * *